US009630749B2

(12) United States Patent
Takigawa

(10) Patent No.: US 9,630,749 B2
(45) Date of Patent: Apr. 25, 2017

(54) SIDE GUSSET BAG FOR PACKAGING A PRODUCT

(71) Applicant: Takigawa Corporation Japan, Chiba Prefecture (JP)

(72) Inventor: Hiroyuki Takigawa, Chiba (JP)

(73) Assignee: Takigawa Corporation Japan, Chiba Prefecture (JP)

( * ) Notice: Subject to any disclaimer, the term of this patent is extended or adjusted under 35 U.S.C. 154(b) by 0 days.

(21) Appl. No.: 14/986,594

(22) Filed: Dec. 31, 2015

(65) Prior Publication Data

US 2017/0066558 A1 Mar. 9, 2017

(30) Foreign Application Priority Data

Sep. 7, 2015 (DE) ..... 10 2015 114 968

(51) Int. Cl.
*B65D 33/01* (2006.01)
*B65D 30/20* (2006.01)

(52) U.S. Cl.
CPC ..... *B65D 31/10* (2013.01)

(58) Field of Classification Search
CPC ..... B65D 31/10; B65D 33/01
USPC ..... 383/100–103, 120
See application file for complete search history.

(56) References Cited

U.S. PATENT DOCUMENTS

2007/0133908 A1* 6/2007 Bruns ..... B31B 19/90 383/95

FOREIGN PATENT DOCUMENTS

| | | | | | |
|---|---|---|---|---|---|
| IT | WO 2008120062 | A2 | * | 10/2008 | ..... B31B 19/36 |
| JP | 08034450 | A | * | 2/1996 | |
| JP | 09216642 | A | * | 8/1997 | |
| JP | 09240689 | A | * | 9/1997 | |
| JP | 11020051 | A | * | 1/1999 | |
| JP | 2002114238 | A | * | 4/2002 | |
| JP | 2002145285 | A | * | 5/2002 | |
| JP | 2002179086 | A | * | 6/2002 | |
| JP | 2005153974 | A | | 6/2005 | |
| JP | 2012091807 | A | * | 5/2012 | |

OTHER PUBLICATIONS

Machine translation of the description of JP 2005-153974 A.*

* cited by examiner

*Primary Examiner* — Jes F Pascua
(74) *Attorney, Agent, or Firm* — Rankin, Hill & Clark LLP

(57) ABSTRACT

The present invention relates to a side gusset bag (1) for packaging a product, with a front bag wall (2), with a rear bag wall (3), with a lower bag end (5) forming a bottom (4), with an upper bag end (6) distant from the lower bag end (5) in vertical direction (V), which upper bag end comprises a bag opening (8) closable by a closure (7), with at least one side gusset (9) extending from the bottom (4) in vertical direction (V), the side gusset connecting the front bag wall (2) with the rear bag wall (3) and forming a side gusset opening (11) at its upper end (10) which faces the upper bag end (6), and with an air-permeable covering tape (12), which covers the entire side gusset opening (11) of the at least one side gusset (9). In order to reduce the risk of oxygen and moisture penetrating into the bag, the invention proposes that at least one first section (13) of the side gusset opening (11) is sealed in an air-tight manner.

13 Claims, 2 Drawing Sheets

SIDE GUSSET BAG FOR PACKAGING A PRODUCT

Figure 1:
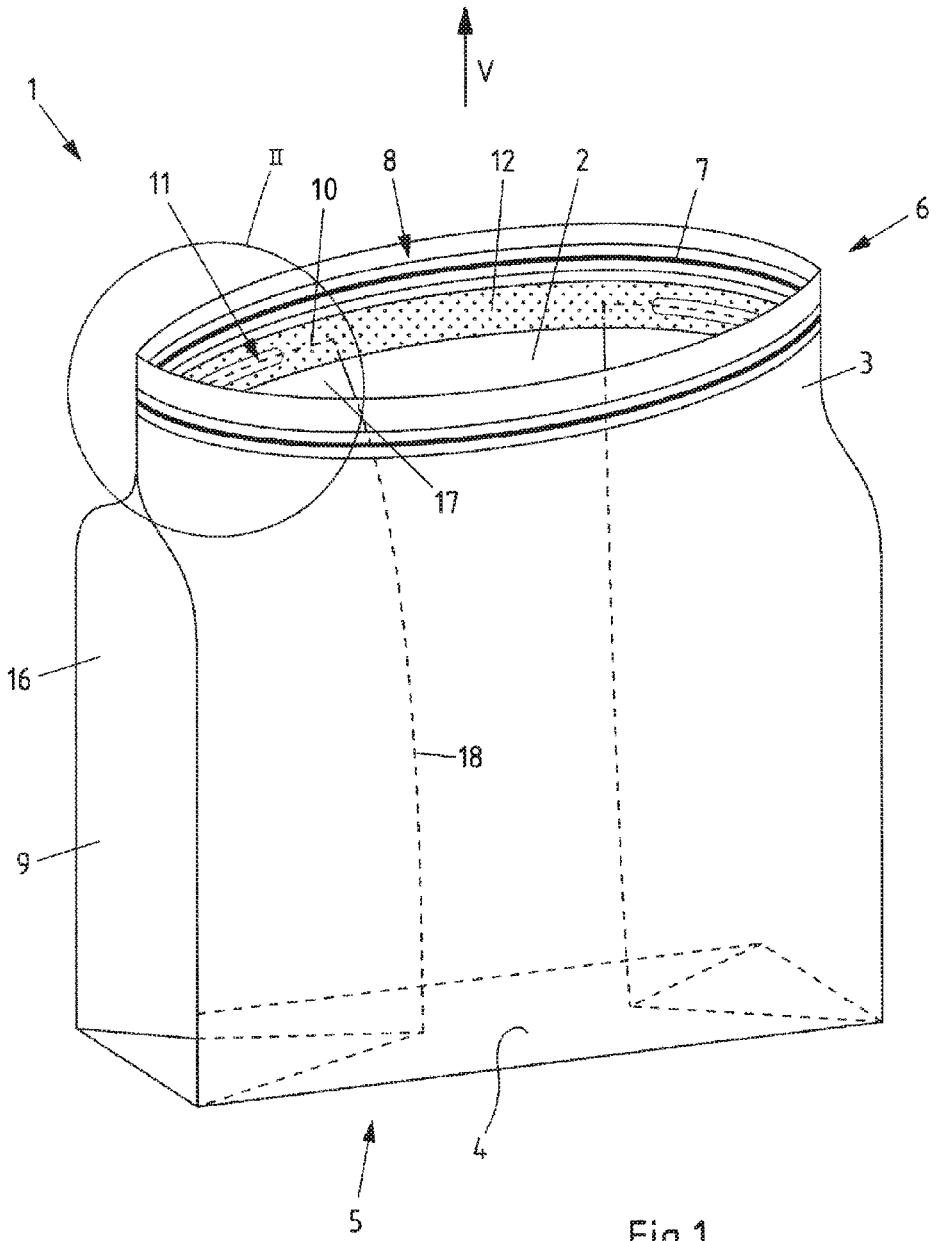

The present invention relates to a side gusset bag for packaging a product, with a front bag wall, with a rear bag wall, with a lower bag end forming a bottom, with an upper bag end distant in vertical direction from the lower bag end, the upper bag end comprising a bag opening closable by a closure, with at least one side gusset extending starting from the bottom in vertical direction, the side gusset connecting the front bag wall with the rear bag wall and forming a side gusset opening at its upper end facing the upper bag end, and with an air-permeable covering tape which covers the entire side gusset opening of the at least one side gusset.

Such a side gusset bag is for example known from JP 2005-153974 A. This known bag comprises a side gusset, which forms the lateral boundary of the bag and connects the front bag wall with the rear bag wall. The side gusset extends in two layers from the outer lateral boundary of the bag into its interior. At their upper end, i.e. the upper end of the side gusset, the two side gusset layers form a slot-shaped side gusset opening which allows an air exchange between the inside of the bag and the bag environment.

Such an air exchange may, for example, be desirable if a plurality of these bags when filled, shall be stored and transported on pallets. This brings with it the risk that the environmental pressure at the location of storage or during transport is less than during filling and sealing of the bags. Such a pressure difference results in the bag blowing up. In this case the side gusset opening provided at the upper end of the side gusset allows for pressure equalisation. Vice versa there is the effect that the bag, when filled with a still warm product and immediately sealed, contracts while cooling down. This brings with it the risk that the bag in this vacuumed state does not have a perfect shape when placed on pallets. In this case too, the side gusset opening ensures that the pressure is equalised. Finally pressure equalisation may be desirable when the filled and sealed bags prior to being placed on pallets, shall be pressed flat in a device destined for such an operation (so-called bag flattener). Otherwise there would be the risk that when bags are being flattened in this device the still warm and soft sealing seams burst open.

Further side gusset bags are known where in case of a side gusset opening at the upper end of the side gusset, a perforation of the material of the side gusset is provided. Although the individual holes of the perforation are very small (so-called micro perforation), there exists the risk that insects deposit their eggs through the holes in the interior of the bag. In order to avoid this kind of infestation the perforated area of the side gusset is normally sealed on the inside with a covering tape in the form of an air-permeable fabric tape. The sealing on the inside of the perforated side gusset is, on the one hand, relatively expensive because the fabric tape must be very precisely aligned and on the other hand, it consumes a relatively large amount of material because the perforation and thus the fabric tape, as a rule, extends beyond the entire vertical extension of the side gusset opening. A further disadvantage consists in that due to the perforation being sealed by a covering strip many holes are clogged with adhesive and thus diminish the effectiveness of the equalisation of pressure.

With the bag mentioned in the beginning and which is also the subject of this invention, the perforation of the side gusset is omitted, and instead the already described side gusset opening is provided at the upper end of the side gusset. In order to avoid infestation by insects with this bag, an air-permeable covering tape is again used, which is glued inside the bag transversely to the vertical direction across the side gusset opening. Gluing is effected in such a way that a distance or slot of at least 1 mm (0.039 inch) is formed between the two upper edges of the side gusset layers, thus forming an air-permeable area at the upper end of the side gusset, which extends across the entire side gusset opening (from the innermost end of the side gusset up to the outer bag seam).

The relatively large gap at the upper end of the side gusset is suitable for pressure equalisation but includes the increased risk of oxygen and moisture penetrating into the side gusset bag, which can lead to a reduction in quality of the product with which the bag has been filled.

It is therefore an object of the present invention to propose a side gusset bag, with which the risk of oxygen and moisture penetrating into the bag is reduced.

With a side gusset bag for packaging a product, as for example animal feed, in particular dry feed, wherein the side gusset bag comprises

- a front bag wall,
- a rear bag wall,
- a lower bag end forming a bottom,
- an upper bag end distant from the lower bag end in vertical direction, which comprises a bag opening closable, in particular reclosable, by a closure,
- at least one side gusset extending in vertical direction from the bottom, which connects the front bag wall with the rear bag wall and at its upper end forms a side gusset opening facing the upper bag end, and
- an air-permeable covering tape, such as a fabric tape, which closes the entire side gusset opening of the at least one side gusset, the object is solved in that at least one first section of the side gusset opening is sealed in an air-tight manner.

A side gusset, in terms of the invention, is understood to be the side part of the lateral part or lateral wall of a side gusset bag, which connects the front bag wall with the rear bag wall. The side gusset comprises at least one front side gusset layer and one rear side gusset layer, wherein the front side gusset layer is bonded to or integrated in one piece (formed integrally) with the front bag wall, and the rear side gusset layer is bonded to or integrated in one piece (formed integrally) with the rear bag wall. Starting from the respective bag wall the side gusset layer extends towards the inside of the bag, where the two side gusset layers are materially bonded to or integrated in one piece (formed integrally) with each other, in particular by forming a kink. On their underside the side gusset layers are bonded to or integrated in one piece (formed integrally) with the bag bottom in an air-tight manner and starting from here, extend upwards as far their upper end, i.e. the upper end of the side gusset. The upper end of the side gusset and/or the side gusset layers is in particular vertically distant from the closure, which for example may be a press or clamping closure, in particular a press tape closure or Velcro closure. Preferably the upper edge and/or the upper end of the side gusset and side gusset layers extend in parallel to the closure and in parallel to the bag opening.

The side gusset opening at the upper end of the side gusset is understood to be the entire area starting from the innermost end of the side gusset (the end of the side gusset protruding the most into the bag) as far as the connection point with the respective bag wall and/or, if provided, as far as the lateral sealing seam of the bag. Of this side gusset opening, at least one section, the said first section, is sealed in an air-tight manner, i.e. in this section it is not possible (if the side gusset bag is used as intended and/or without destroying the side gusset bag) for air from the environment to penetrate into the inside of the bag or from the inside of the bag into the environment. In this way the area defined as the side gusset opening between the inner end of the side gusset and the connection point with the respective bag wall and/or the lateral sealing seam is not completely air-permeable as with the state of the art, but is closed, at least partially, in an air-tight manner. The area of the side gusset opening, through which oxygen or moisture may get into the interior of the bag, is thus smaller than in the state of the art, so that a reduction in quality of the packaged product through contact with oxygen or moisture is also less. In other respects the risk of infestation through insects is also reduced, since it is almost completely impossible for an insect to deposit eggs inside the bag through the reduced area of the side gusset opening and past the covering tape.

According to the invention the covering tape may be an air-permeable fabric tape, in particular a multi-layer fabric tape with at least one perforated fabric tape layer and one unperforated fabric tape layer.

Due to the idea according to the invention of leaving the side gusset and side gusset opening known as such unchanged as regards shape and construction, and of merely permanently closing a partial area of the side gusset opening in an air-tight manner, it becomes possible for the side gusset bags to retain the same construction and the same dimensions, as tried and trusted in the state of the art. Also the side gusset bags can be manufactured on the same production machines as the bags known from the art. Constructional changes are not required, neither with the side gusset bag nor with the production machine, in order to achieve a reduction in air-permeability and thus a reduction in the risk of oxygen or moisture getting into the bag.

According to one embodiment of the side gusset bag according to the invention, the first section is sealed in an air-tight manner by a sealing seam, in particular a hot-sealing seam or adhesive seam. In other words a partial area of the side gusset opening is closed by material-bonding or melting (hot-sealing) or gluing.

According to a further embodiment of the side gusset bag according to the invention, at least one second section of the side gusset opening is air-permeable. By air-permeable is understood that at least a minimal air exchange and thus pressure equalisation is possible between the bag environment and the inside of the bag. In principle it is however also feasible that such a second section is omitted if the side gusset opening is to be closed in an air-tight manner (hermetically) in relation to the environment.

According to yet another embodiment of the side gusset bag according to the invention, the covering tape connects the side gusset, in particular the upper end of the side gusset, with the rear bag wall, wherein the covering tape is glued, at least in sections, to the rear bag wall and to the side gusset, and in particular across the entire length and/or transverse extension (extension transversely to the vertical direction) of the side gusset opening.

According to another embodiment of the side gusset bag according to the invention, the side gusset comprises a front side gusset layer directly adjacent to the front bag wall and a rear side gusset layer directly adjacent to the rear bag wall, wherein the front side gusset layer and the rear side gusset layer are materially bonded to each other at their upper end, i.e. at the upper end of the side gusset, by a sealing seam. The material bond is accomplished in such a way as to create a gap or slot of less than 1 mm (0.039 inch), preferably less than 0.75 mm (0.03 inch), especially preferably less than 0.5 mm (0.02 inch), between the two upper edges of the side gusset layers. This area, in which the two side gusset layers are connected with each other by the sealing seam, is the previously mentioned first section of the side gusset opening. The sealing, which connects the side gusset layers with each other, is an area comprising, in particular, molten and hardened-again plastic or an area comprising hardened plastic. This hardened plastic or adhesive is present only vertically above the upper edge of the side gusset or the side gusset layers. The surfaces of the two side gusset layers forming the outside of the side gusset are not fixedly connected with each other (but can contact each other) and are, in particular, not materially bonded to each other. In other words, sealing (air-tight sealing) of the first section of the side gusset opening is effected exclusively on the inside of the bag.

According to a further embodiment of the side gusset bag according to the invention, the front side gusset layer and the rear side gusset layer are free from a sealing seam in the at least one second section. By forming a section, which is free from a sealing seam and also in other respects is not sealed in an air-tight manner, air permeability of the bag is obtained in a simple way, which allows pressure equalisation between the environment and the inside of the bag. In particular, the covering tape, with the exception of a small area directly vertical above the second section of the side gusset opening, is glued to the rear bag wall and to that side of the front side gusset layer, which faces the front bag wall. This narrow, unsealed (not materially bonded) area of the covering tape is the only area through which air can pass through the side gusset opening. Preferably the side of the rear side gusset layer facing the rear bag wall is connected with the rear bag wall in an air-tight manner, in particular by means of a material bond, such as hot sealing or gluing.

According to yet another embodiment of the side gusset bag according to the invention, the side gusset, in particular the front side gusset layer and the rear side gusset layer, comprise a transverse extension (horizontal extension) extending orthogonally to the vertical direction, which ends at an inner side gusset end, wherein the at least one second section lies completely within that half of the transverse extension which is adjacent to the inner side gusset end. The inner side gusset end is understood to be the connection point, in particular the kinked edge, between the rear side gusset layer and the front side gusset layer. Preferably the at least one second section lies completely within that third of the transverse extension which is adjacent to the inner side gusset end, especially preferably within that quarter of the transverse extension which is adjacent to the inner side gusset end. In other words, the air-permeable area lies as far as possible inside the side gusset bag and as closely as possible to the connection point between the front side gusset layer and the rear side gusset layer. Access to this area is particularly difficult, which means that insects find it even more difficult to reach the area of the side gusset opening for depositing their eggs. Moreover the air exchange in this area is made distinctly more difficult, due to the special arrangement of individual material layers in the area of the side gusset opening, in particular because here individual material layers are pressed against each other. The latter has the advantage that in the normal state, i.e. when there is no external pressure acting on the side gusset bag, or when pressure equalisation has completely finished, no significant quantities of oxygen or moisture can get from the environment into the inside of the bag. In other words, due to the especial construction according to the invention, the second section of the side gusset opening acts as a valve, which albeit in case of a pressure difference makes pressure equalisation possible between the inside of the bag and the environment, but for equal pressures closes the side gusset opening.

According to another embodiment of the side gusset bag according to the invention, only one single second section is provided. This single section is located, as mentioned, completely within the inner half, preferably the inner third, especially preferably the inner quarter, of the transverse extension of the side gusset.

According to yet another embodiment of the side gusset bag according to the invention, the at least one second section comprises a length (dimension orthogonally to the vertical direction) of less than 40 mm (1.575 inch), preferably of less than 25 mm (0.984 inch), especially preferably of less than 15 mm (0.591 inch). For example the length of the second section is only 10 mm (0.394 inch). In principle the length could also be 0 mm (0 inch), i.e. the second section is not present and/or the entire side gusset opening is sealed so as to be completely air-tight.

According to another embodiment of the side gusset bag according to the invention, the front side gusset layer (in a no-load situation of the side gusset bag, i.e. when there is no external pressure on the side gusset bag and/or when pressure equalisation is completely finished) touches the rear side gusset layer within the at least one second section. This supports the valve-like function of the second section already mentioned above.

Figure 2A:
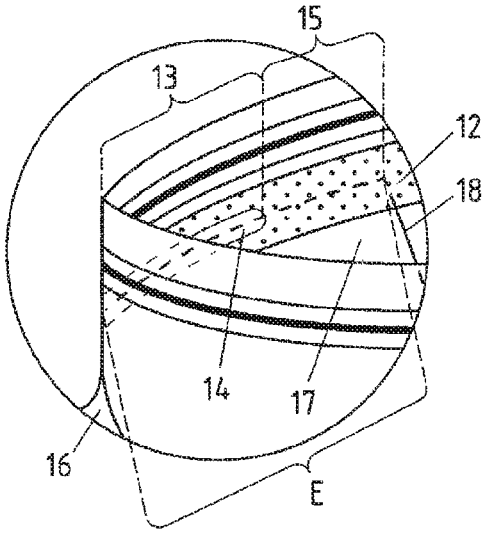
Figure 2B:
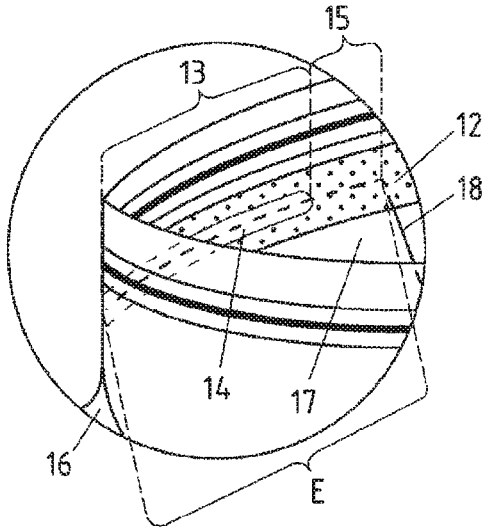
Figure 2C:
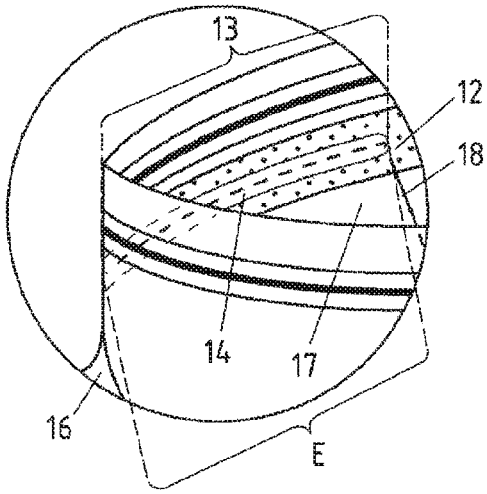

There exists a plurality of possibilities to further develop the side gusset bag according to the invention. In this respect reference should be made on the one hand, to the Claims subordinate to claim 1, and on the other hand, to the description of exemplary embodiments in conjunction with the drawing, in which:

FIG. 1 shows a schematic view of a side gusset bag according to the present invention;

FIG. 2*a* shows an enlarged section of FIG. 1 with a first example of a side gusset opening;

FIG. 2*b* shows an enlarged section of FIG. 1 with a second example of a side gusset opening;

FIG. 2*c* shows an enlarged section of FIG. 1 with a third example of a side gusset opening.

FIG. 1 schematically shows a side gusset bag 1 for packaging a product, for example an animal feed, in a perspective view.

The side gusset bag 1 comprises a front bag wall 2 and a rear bag wall 3. The front bag wall 2 and the rear bag wall 3 are connected on their underside with a bottom 4 which forms the lower bag end 5. In vertical direction V distant from the bottom 4, an upper bag end 6 is formed by the upper ends of the front bag wall 2 and the rear bag wall 3. In the region of the upper bag end 6, also called bag head, the front bag wall 2 is laterally directly connected with the rear bag wall 3. At its upper end 6 the bag comprises a bag opening 8, which is closable by a closure 7. The bag opening 8 is shown in an opened state. In the present example the closure 7 is a reclosable press closure.

On both sides the side gusset bag 1 respectively comprises one side gusset 9 extending from the bottom 4 in vertical direction V, which connects the front bag wall 2 with the rear bag wall 3. In the present exemplary embodiment the side gusset 9 comprises a front side gusset layer 16 directly adjacent to the front bag wall 2 and a rear side gusset layer 17 directly adjacent to the rear bag wall 3, wherein the two side gusset layers 16 and 17 are connected with each other towards the inside of the bag and connected with the respectively adjacent bag walls 2 and 3 towards the outside of the bag. At its lower end the side gusset 9 and/or the side gusset layers 16 and 17 are connected with the bottom 4 in an air-tight manner. The vertical extension of the side gussets 9 is less than the vertical extension of the front and rear bag walls 2 and 3, so that the side gusset 9 and/or the front and rear side gusset layers 16 and 17 end vertically below the upper bag end 6 and also vertically below the closure 7. The upper end 10 of the side gusset 9 and/or the front and rear side gusset layers 16 and 17 forms a side gusset opening 11 facing the upper end 6, which (atmospherically) connects the bag environment with the inside of the bag.

An air-permeable covering tape 12 covers the entire side gusset opening 11 and closes the same in an air-permeable manner. The covering tape 12 in this case may e.g. be a fabric tape consisting of at least two fabric layers, of which the one layer comprises a perforation, whilst the other does not. The covering tape 12 extends transversely to the vertical direction V along the entire inside of the rear bag wall 3. The covering tape 12 overlaps with the upper end 10 of the side gusset 9, so that the side gusset 9, over its entire width in the area of its upper end 10, is connected with the rear bag wall 3.

In FIGS. 2*a* to *c* the exact construction of the upper end 10 of the side gusset 9 and in particular the side gusset opening 11 is shown as a detail enlargement II. FIGS. 2*a* to *c* each show different exemplary embodiments.

In all exemplary embodiments a first section 13 of the side gusset opening 11 is sealed in an air-tight manner by a sealing seam 14. In the present case the sealing seam 14 is e.g. a hot-sealing seam.

Further, in FIGS. 2*a* and *b* a second section 15 of the side gusset opening 11 is configured in an air-permeable manner in that in this area there is no sealing seam closing the side gusset opening in an air-tight manner. The first section 13 and the second section 15 together form the side gusset opening 11 in FIGS. 2*a* and *b*.

When comparing FIGS. 2*a* to *c* with each other, it can be seen that the first section 13 is of a different length in each case. In FIG. 2*a* the first section 13 extends over somewhat more than half of the side gusset opening 11, starting from the left side of the bag. In the exemplary embodiment of FIG. 2*b* the first section 13 extends over somewhat more than ¾ of the entire side gusset opening 11. In FIG. 2*c* the first section 13 extends over the entire side gusset opening 11 and in particular somewhat beyond it.

In all exemplary embodiments the first section 13 is longer than the second section 15. For example the second section 15 in FIG. 2*a* has a length of 20 mm (0.787 inch). The second section 15 in FIG. 2*b* is shorter than that in FIG. 2*a*, and may e.g. have a length of 10 mm (0.394 inch). In FIG. 2*c* the length of the second section is zero, i.e. the second section does no longer exist here.

When comparing FIGS. 2*a* and *b* it can be seen that the second section 15 lies very close to the inner side gusset end 18 and thus very close to an area of the side gusset opening 11 which is very difficult to access from the outside. More accurately expressed, the side gusset 9 has a transverse extension E extending orthogonally to the vertical direction V, which ends at said inner side gusset end 18, wherein in FIG. 2*a* the second section 15 lies completely within that half of the transverse extension E which is adjacent to the inner side gusset end 18. In FIG. 2*b* moreover, the second section 15 lies completely within the quarter of the transverse extension E of the side gusset 9, which is adjacent to the inner side gusset end 18.

The covering tape 12, at least in the upper and lower marginal area (marginal area along its longitudinal edges), is materially bonded in an air-tight manner to the rear bag wall 3 and the upper end 10 of the side gusset 9. Preferably however, the covering tape 12 is materially bonded in an air-tight manner all over its surface to the rear bag wall 3 and the upper end 10 of the side gusset 9, wherein however, in order to form the second air-permeable section 15, there must then be no material bond along a partial section of the side gusset opening 11. In the latter case therefore, there is then no material bond, such as by gluing or sealing, in a strip directly above the upper edge of the side gusset 9, nor, as the case may be, in a strip directly below the upper edge of the side gusset 9; this area is therefore air-permeable.

In the first completely air-tight section the front side gusset layer 16 and the rear side gusset layer 17 are materially bonded by a sealing seam. In the area of the second section 15 the front side gusset layer 16 and the rear side gusset layer 17 merely touch each other (loose contact), there being thus no further connection apart from the loose contact, in particular no material bond between the two side gusset layers 16 and 17.

Due to the special construction in the region of the upper bag end 10 of the side gusset 9 and the side gusset opening 11, the side gusset bag 1 previously described by way of example in the figures allows pressure to be equalised in case of a pressure difference between the inside of the bag and the environment. At the same time, in case there exists no pressure difference between the inside of the bag and the environment, the front side gusset layer 16 and the rear side gusset layer 17 lie so closely together within the second section 15 serving pressure equalisation, that there is no noticeable risk of oxygen or moisture penetrating into the inside of the bag. Also the risk of infestation is further reduced due to the construction according to the invention.

The invention claimed is:

1. A side gusset bag for packaging a product, comprising a front bag wall, a rear bag wall, a lower bag end forming a bottom, an upper bag end distant from the lower bag end in a vertical direction, which has a bag opening closable by a closure, a side gusset extending from the bottom in the vertical direction, which connects the front bag wall with the rear bag wall, said side gusset comprising a front side gusset layer directly adjacent to the front bag wall and a rear side gusset layer directly adjacent to the rear bag wall, said side gusset having a side gusset opening at an upper end that faces the upper bag end, said side gusset opening being defined solely by upper edges of the front side gusset layer and the rear side gusset layer, and an air-permeable covering tape, which covers the entire side gusset opening of the side gusset, wherein a first section of the side gusset opening is sealed in an air-tight manner such that it is not possible for air to penetrate into an inside of the bag through said first section wherein a second section of the side gusset opening is air-permeable, and wherein said first section is longer than said second section.

2. The side gusset bag according to claim 1, wherein the first section is sealed in an air-tight manner by a sealing seam.

3. The side gusset bag according to claim 2, wherein the front side gusset layer and the rear side gusset layer are connected with each other at the upper end by the sealing seam.

4. The side gusset bag according to claim 3, wherein the front side gusset layer touches the rear side gusset layer within the at least one second section.

5. The side gusset bag according to claim 1, wherein the covering tape connects the side gusset with the rear bag wall, wherein the covering tape is glued, at least in sections, to the rear bag wall and the side gusset.

6. The side gusset bag according to claim 1, wherein the front side gusset layer and the rear side gusset layer are free from a sealing seam in the at least one second section.

7. The side gusset bag according to claim 1, wherein the side gusset has a transverse extension extending orthogonally to the vertical direction, which ends at an inner side gusset end, wherein the at least one second section lies completely within one half of the transverse extension, which is adjacent to the inner side gusset end.

8. The side gusset bag according to claim 7, wherein the at least one second section lies completely within one third of the transverse extension, which is adjacent to the inner side gusset end.

9. The side gusset bag according to claim 7, wherein the at least one second section lies completely within one quarter of the transverse extension, which is adjacent to the inner side gusset end.

10. The side gusset bag according to claim 1, wherein only one single second section is provided.

11. The side gusset bag according to claim 1, wherein the at least one second section comprises a length of less than 1.575 inch.

12. The side gusset bag according to claim 1, wherein the at least one second section comprises a length of less than 0.984 inch.

13. The side gusset bag according to claim 1, wherein the at least one second section comprises a length of less than 0.591 inch.

* * * * *